United States Patent [19]

Tomonaga

[11] 4,275,135

[45] Jun. 23, 1981

[54] ELECTROPHOTOGRAPHIC $CdS.nCdCO_3$ CONTAINING MANGANESE STEARATE

[75] Inventor: Tetsuo Tomonaga, Nishinomiya, Japan

[73] Assignee: Minolta Camera Kabushiki Kaisha, Osaka, Japan

[21] Appl. No.: 56,576

[22] Filed: Jul. 11, 1979

Related U.S. Application Data

[63] Continuation-in-part of Ser. No. 913,978, Jun. 7, 1978, abandoned.

[30] Foreign Application Priority Data

Mar. 8, 1978 [JP] Japan ..... 53-26797
Oct. 14, 1978 [JP] Japan ..... 53-126430

[51] Int. Cl.[3] ..... G03G 5/087; G03G 5/09
[52] U.S. Cl. ..... 430/95; 430/94; 430/135
[58] Field of Search ..... 430/94, 95, 135

[56] References Cited

U.S. PATENT DOCUMENTS

| | | | |
|---|---|---|---|
| 3,373,020 | 3/1968 | Tomanek | 430/56 |
| 3,489,560 | 1/1970 | Joseph | 430/84 |
| 3,494,789 | 2/1970 | Makino et al. | 430/94 |
| 3,506,595 | 4/1970 | Makino et al. | 430/94 |
| 3,589,928 | 6/1971 | Sawato et al. | 430/94 |
| 4,029,604 | 6/1977 | Enoki et al. | 430/94 X |
| 4,123,271 | 10/1978 | Fushida et al. | 430/89 |

FOREIGN PATENT DOCUMENTS

| | | |
|---|---|---|
| 2402907 | 8/1974 | Fed. Rep. of Germany . |
| 45-31144 | 10/1970 | Japan . |
| 49-122741 | 11/1974 | Japan . |

*Primary Examiner*—Roland E. Martin, Jr.
*Attorney, Agent, or Firm*—Wolder, Gross & Yavner

[57] ABSTRACT

A photoconductive insulating layer for an electrophotographic sensitive member formed of a fine powder of $CdS.nCdCO_3$, wherein $0<n\leqq 4$, bonded by an insulating resin and having manganese stearate dispersed therein. Advantageously the $CdS.nCdCO_3$ contains copper as an acceptor impurity in an amount of between about 0.025 and 0.1 grain atomic weight of copper per 100 gram atomic weight of cadmium, the manganese stearate is present in an amount of about 2 to 4 parts by weight per 100 parts by weight of $CdS.nCdCO_3$ and is preferably adherent thereto, the layer is between 10 and 100 microns thick and the $CdS.nCdCO_3$particle size is about 1 to 2 microns or less. In producing the layer the $CdS.nCdCO_3(Cu)$ is produced by reacting Cd, Cu and $CO_3$ compounds in an aqueous solution, reacting the resulting precipitate with a sulfide, grinding and calcining the reaction product, then dispersing the calcined powder with the manganese stearate applied thereto or together therewith and the resin in a solvent and spray coating the dispersion in a conductive substrate and then heat treating to harden the resin. Additionally, the electrophotographic sensitive member preferably comprises an insulating protective layer on the photoconductive insulating layer to prevent the cause for filming phenomenon.

9 Claims, 4 Drawing Figures

ELECTROPHOTOGRAPHIC $CdS.nCdCO_3$ CONTAINING MANGANESE STEARATE

REFERENCE TO RELATED APPLICATION

The present application is a continuation-in-part of Application Ser. No. 913,978 filed on June 7, 1978, now abandoned.

BACKGROUND OF THE INVENTION

The present invention relates generally to improvements in electrophotographic sensitive members for use in an image transfer type copying apparatus and it relates more particularly to an improved electrophotographic sensitive member which comprises a photoconductive insulating layer with cadmium sulfide and cadmium carbonate as its main constituents and preferably with an insulating protective layer thereon, and to a method for producing the same.

Electrophotographic sensitive members which utilize a photosensitive material of $CdS.nCdCO_3$ ($0<n\leqq 4$) as a photoconductive insulating layer and processes for their production are described in U.S. Pat. No. 3,494,789 and U.S. Pat. No. 3,589,928. The photosensitive member of the type described in these patents has the advantages that the member can be electrostatically charged to both positive and negative polarities and that the manufacture thereof is relatively simple and inexpensive whereas the disadvantages or drawbacks which this type of photosensitive member has are that with a photosensitive material of $CdS.nCdCO_3$ alone, satisfactory photosensitivity and charging characteristics (i.e., charging capability) cannot be attained thereby requiring the addition of an acceptor impurity of copper or silver as an activator to the photosensitive material in the calcination step or in the dispersion step into the resin binder of the $CdS.nCdCO_3$ or in the sulfide reaction step of $CdCO_3$ in the manufacturing process, and that in the actual copying operation, memory phenomenon occurs which is the reproduction of a residual image of the previous original on a next copy image.

As an example of a process for producing a photoconductive powder of $CdS.nCdCO_3$ which is described in U.S. Pat. No. 3,589,928, an aqueous solution of cadmium ions, carbonate ions and hydrogen sulfide, ammonium sulfide or sodium sulfide is reacted to form a precipitate and the precipitate is then calcined at a temperature of less than 400° C. to obtain the powder. In this process, the precipitate itself is obtained in accordance with the following reaction formula (1) which is:

$$CdCO_3+S^{2-}\rightarrow CdS.nCdCO_3 \quad (1)$$

However, satisfactory photosensitivity and charging capability cannot be attained with the photoconductive material of $CdS.nCdCO_3$ alone and for this purpose, it is necessary to add an acceptor impurity of copper as described above. This is generally accomplished by the process satisfying the reaction formula (2) in which the desired amount of copper is added in the reaction of $CdCO_3+S^{2-}$ of formula (1):

$$CdCO_3+Cu^{2+}+S^{2-}\rightarrow CdS(Cu).nCdCO_3 \quad (2)$$

Accordingly, copper is diffused in the cadmium sulfide to improve the sensitivity characteristic of the photoconductive material in the process described above. However, regardless of the process used to produce the photoconductive powder, the electrophotographic sensitive member which comprises a photoconductive insulating layer of $CdS.nCdCO_3$ is greatly influenced in its spectral sensitivity depending upon the amount of copper added, and in particular, the peak of sensitivity tends to shift relatively toward the long wave length as the amount of copper added increases, and as a result, the photosensitivity to white light is improved and there is also exhibited a tendency to stabilize the charging characteristic.

The spectral sensitivity strongly influences the reproduction of an image from a color original and there arises the problem that reproducibility of an image from an original having a reddish color image becomes notably poor if the amount of copper added is relatively large in quantity. This, of course, could be solved by reducing the amount of copper so as to establish a spectral sensitivity in the region close to relative luminous efficiency. But, a difficulty is encountered in uniformly adding a minute amount of copper in cadmium sulfide particles and as a consequence, the electrophotographic sensitive member thus manufactured would tend to exhibit manufacturing instability particularly in dark decay speed, charging capability and spectral sensitivity due to non-uniform diffusion of copper in the cadmium sulfide.

In addition to the aforedescribed drawbacks, another drawback is experienced by the $CdS.nCdCO_3$ resin binder type photosensitive member in which the memory phenomenon is exhibited. This, as described above, is the phenomenon in which a residual image of a previously copied original is reproduced on a subsequently copied image and the cause thereof is assumed to originate from differences in the sensitivities of the image area and the non-image area between previous and next consecutive copyings. Thus, a clear and high contrast image cannot be obtained unless these drawbacks are solved.

The $CdS.nCdCO_3$ photoconductive layer has still further drawbacks in the surface hardness, smoothness and abrasiveness of the layer itself and when the same is employed, for example, in a powder image transfer type copying apparatus, the surface thereof will be damaged and worn out by physical contact with developer and cleaning means. Such drawbacks are particularly noticeable when an elastic blade having an edge contacting the photoconductive layer is used as the cleaning means since some residual developer tends to become buried in the photoconductive layer rather than being scraped off therefrom causing what is known as a filming phenomenon. This will cut the life of photoconductive layer making it unsuitable for long use.

SUMMARY OF THE INVENTION

It is accordingly a primary object of the present invention to provide a novel and improved electrophotographic sensitive member free of the aforedescribed drawbacks and which is capable of producing an image of high quality and a method of producing the same.

Another object of the present invention is to provide an electrophotographic sensitive member for use in an image transfer type copying apparatus which comprises a photoconductive insulating layer of $CdS.nCdCO_3$ ($0<n\leqq 4$) with a small amount of manganese stearate included therein to prevent the occurrence of memory phenomenon.

Still another object of the present invention is to provide an electrophotographic sensitive member which is obtained by dispersing a photoconductive fine powder of $CdS(Cu).nCdCO_3(Cu)$ and manganese stearate in a resin and solvent followed by heat treatment to harden the same.

Still another object of the present invention is to provide an electrophotographic sensitive member which comprises a photoconductive insulating layer of $CdS.nCdCO_3$ and an insulating protective layer thereon having fine properties in surface hardness, surface smoothness and abrasiveness.

Still another object of the present invention is to provide a novel process for producing an electrophotographic sensitive member which comprises a photoconductive insulating layer of $CdS.nCdCO_3$ with high production uniformity, particularly in the properties of dark decay speed, charging capability and spectral sensitivity.

These and other objects of the present invention are achieved by providing an electrophotographic sensitive member which comprises a photoconductive insulating layer of $CdS.nCdCO_3$ in which copper as an acceptor impurity is uniformly diffused both in the cadmium sulfide and cadmium carbonate to improve the reproducibility of an image from an original having reddish colored portions, in which manganese stearate is added to prevent the cause of memory phenomenon and in which preferably an insulating protective layer is formed on the photoconductive insulating layer to avoid the cause for filming phenomenon.

For a fuller understanding of the nature and objects of the present invention, reference is made to the following detailed description taken in conjunction with the accompanying drawings.

DESCRIPTION OF THE PREFERRED EMBODIMENTS

Figure 1:
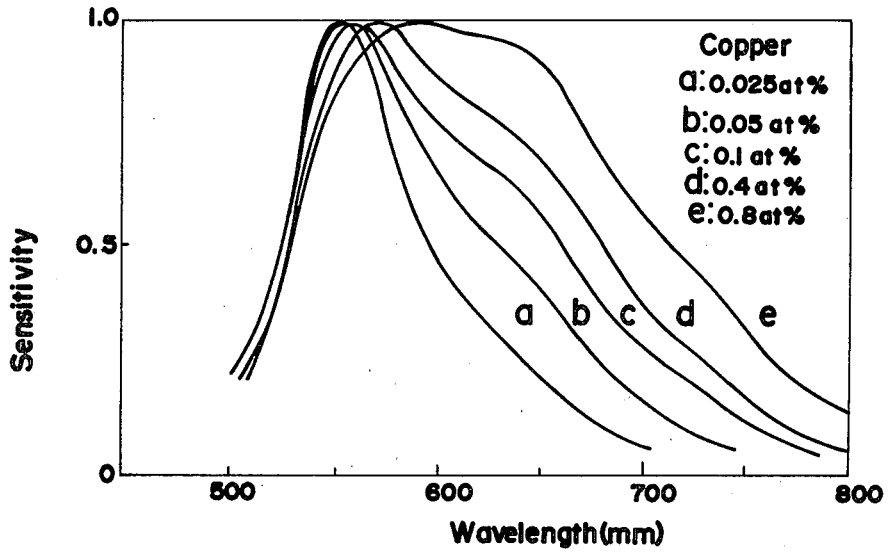
FIG. 1 is a graph showing the spectral sensitivities of electrophotographic sensitive members with the amount of copper added varying from one to another wherein the vertical axis and horizontal axis respectively represents sensitivity and wave length.

It has been found by extensive experimentation that a uniform and even diffusion of an acceptor impurity in cadmium sulfide and cadmium carbonate can be achieved by pre-adding the acceptor impurity in the raw material of cadmium carbonate ($CdCO_3$) with which the photoconductive fine powder of $CdS.nCdCO_3$ is obtained. This manner of addition of the acceptor impurity was found to permit reproduction of reddish colored original image faithfully even in the low density region of acceptor impurity. It was also discovered that adding a predetermined amount of manganese stearate prevents the occurrence of the memory phenomenon without degrading other important characteristics of electrophotographic properties.

Considering first the advance addition of the acceptor impurity, specifically copper, to the cadmium carbonate, this can be done by reacting an aqueous solution of a soluble cadmium compound and an aqueous solution of a carbonate with a predetermined amount of copper to form a precipitate of cadmium carbonate in which the copper is uniformly diffused in accordance with the following reaction formula (3):

$$Cd^{2+} + Cu^{2+} + CO_32- \rightarrow CdCO_3(Cu) \quad (3)$$

As a specific example for producing $CdCO_3(Cu)$, an aqueous solution of cadmium nitrate to which a predetermined amount of copper in a form of $CuCl_2$ is added and dissolved is reacted with an aqueous solution ammonium carbonate of $NH_4(CO_3)_2$ or ammonium bicarbonate $NH_4HCO_3$ by equivalently dropping the respective aqueous solutions into a reaction tank to effect the following reaction formula (4):

$$Cd(NO_3)_2 + CuCl_2 + NH_4(CO_3)_2 \rightarrow CdCO_3(Cu) + 2NH_4NO_3 + NH_4Cl \quad (4)$$

Using the $CdCO_3(Cu)$ precipitate obtained in accordance with reaction formulas (3) and (4) as the raw material, the same is rinsed and dried and then reacted with hydrogen sulfide, sodium sulfide or with ammonium sulfide to form a precipitate of cadmium sulfide and cadmium carbonate with copper uniformly diffused in the cadmium sulfide as well as in the cadmium carbonate. This reaction follows the following reaction formula (5):

$$CdCO_3(Cu) + S^{2-} \rightarrow CdS(Cu).nCdCO_3(Cu) \quad (5)$$

If an aqueous solution of hydrogen sulfide is used as the reactant, then the reaction is in accordance with formula (6) which is:

$$CdCO_3(Cu) + H_2S \rightarrow CdS(Cu).nCdCO_3(Cu) + H_2CO_3 \quad (6)$$

The precipitate of $CdS(Cu).nCdCO_3(Cu)$ thus obtained is rinsed, dried and ground. The ground precipitate is then placed in crucible quartz and calcined at a temperature of less than 350° C. for about 3 to 15 hours to obtain the photoconductive composition in a finely divided or fine powder state. This fine powder having an average particle size of about 1 to 2 microns or even less is dispersed in a heat curable resin together with a solvent and the resulting solution is uniformly sprayed or coated on an electroconductive support (such as aluminum) to the desired thickness. It is then heat cured at a temperature of about 150° C. to 230° C. for about 0.5 to 1.5 hours to obtain the final electrophotographic sensitive member. It should be noted that the reason for setting temperature below 350° C. at the calcination step is primarily due to the tendency of thermal decomposition of cadmium carbonate above 350° C. It is preferable to set the temperature below 300° C.

Accordingly, even in the case where the amount of added copper is less to establish a spectral sensitivity in the region close to the relative luminousity for fine reproduction of a reddish colored original, as will be discussed hereinafter in connection with FIG. 1, copper is uniformly diffused in the cadmium sulfide and cadmium carbonate so that a reddish colored original may be reproduced simply without lowering the charging capability. In other words, copper was non-uniformly diffused in cadmium sulfide in the conventional photoconductive insulating layer of $CdS.nCdCO_3$ whereas in the composition of the present invention, copper is uniformly diffused in the cadmium sulfide even with a small amount and by this, fine reproduction of a reddish colored original becomes possible without impairing the stabilities of the sensitivity and charging capability which are essential purposes for adding copper. As will be explained hereinafter, it is preferable that an amount of copper to be added be about 0.025 to 0.1 atomic % per 100 atomic % of cadmium.

Considering now the inclusion of manganese stearate in accordance with the present invention for the prevention of the memory phenomenon, although there are numerous materials which have been proposed to improve the light fatigue property of electrophotographic sensitive members, none of them show any effect in preventing the occurrence of the memory phenomenon. In accordance with the present invention, it was found that manganese stearate was most highly effective in preventing the occurrence of the memory phenomenon without causing any degradation in electrophotographic properties and manufacturing uniformity. The amount of manganese stearate added is preferably in the range of about 2 to 4 parts by weight per 100 parts by weight of the photoconductive fine powder of cadmium sulfide and cadmium carbonate (i.e., $CdS(Cu).nCdCO_3(Cu)$) and the manganese stearate is preferably adhered directly to the photoconductive fine powder after calcination or dispersed in the solvent with resin and the fine powder.

The description will now be directed to an insulating protective layer which is to be formed on the $CdS.nCdCO_3$ photoconductive insulating layer obtained in the manner described above and including therein the uniformly dispersed acceptor impurity and a small amount of manganese stearate. When the surface of $CdS.nCdCO_3$ photoconductive layer itself is used as an image forming surface, the surface thereof will become physically damaged by a cleaning means and developer and in particular the filming phenomenon caused by developer occurs as the photoconductive layer is repeatedly used. This filming phenomenon is most often observed when an elastic blade having an edge contacting the surface of photoconductive layer or a rotatable fur brush in contact with the photoconductive layer is used as cleaning means for removing residual toner, some composition of toner by frictional contact with the cleaning means tends to become buried or adhered on the photoconductive layer causing the electrophotographic characteristics to deteriorate. These drawbacks are believed primarily to be caused by insufficiencies in surface hardness, abrasiveness and smoothness of the photoconductive layer. In the present invention, an insulating protecting layer having a thickness of about 0.2 to 2 microns is formed on said $CdS.nCdCO_3$ photoconductive insulating layer. If the thickness of this layer is less than 0.2 micron, the layer itself no longer functions as a protective layer and if it is thicker than 2 microns, fine electrophotographic characteristics of the photoconductive insulating layer deteriorate and in particular, residual potential rises making it unsuitable for repetitive use. Any kind of material can be used for the insulating protective layer as long as it has light transparency and fine ability to retain electrostatic charges thereon. Preferably, resin such as silicon resin, acryl resin, melamine resin, fluorine resin, polyester resin, vinyl resin, amino resin, urethane resin or any mixture thereof should be used. These resins depending upon inclusion of catalyst and other material are either thermo, ultraviolet or normal temperature setting resin. Thus, in forming the layer, resin with or without catalyst and other suitable material is mixed for example with alcohol and coated onto the photoconductive layer into a desired thickness. Subsequently, the same is either heat cured at a temperature of about 100° to 200° C., exposed to ultraviolet rays or left it under normal temperature environment to harden the coated layer depending on the property of resin used. Here, it should be noted that the formation of insulating protective layer on the $CdS.nCdCO_3$ is not essential but only preferable to avoid thhe occurrence of filming phenomenon. Thus, where there is no occurrence of filming phenomenon, the $CdS.nCdCO_3$ photoconductive layer alone will be sufficient.

The electrophotographic sensitive member obtained in accordance with the present invention may be used in any type of copying apparatus, but is preferably used in an image transfer type copying apparatus in which an electrostatic latent image formed on the member is developed with a toner and subsequently transferred to a copy paper or in which the electrostatic latent image is directly transferred to the copy paper which is thereafter developed. These types of copying apparatuses are well known in the art, such as those described in U.S. Pat. No. 3,090,616 and U.S. Pat. No. 3,997,262 so that detailed description thereof will be omitted herein.

The following describes specific examples some of which are produced in a conventional manner for purposes of comparison with devices in accordance with the present invention. In all of the examples with the exception of Example 5, only the $CdS.nCdCO_3$ photoconductive insulating layers were prepared because electrophotographic characteristics discussed therein are not influenced even by provision of the insulating protective layer thereon. For the photoconductive insulating layer, it should be noted that, although copper in a form of $CuCl_2$ is used, copper nitrate may be used instead. Also, ammonium sulfide, sodium sulfide and other similar material may be used as the reactant in place of hydrogen sulfide. Furthermore, a heat curing acryl resin may be used in combination with an epoxy resin and amino resin in weight ratio of about 7:2:1. The epoxy and amino resins will act as bridging additive to harden and increase the surface strength of the photoconductive insulating layer. Additionally, the thickness of the photoconductive insulating layer may be anywhere between 10 and 100 microns, but is normally about 20 to 60 microns. Moreover, n in $CdS.nCdCO_3$ may be in the range of $0<n\leqq 4$, but is preferably about 0.5 to 2.

EXAMPLE 1

This example pertains to the conventional photosensitive member. 173 grams of cadmium carbonate was dispersed in an aqueous solution containing 0.68 grams of cupric chloride ($CuCl_2$) and then reacted with hydrogen sulfide to form a precipitate of $CdS(Cu).nCdCO_3$. This reaction is in accordance with the reaction formula (2). The amount of copper present in the precipitate was found to be 0.4 atomic % per 100 atomic % of cadmium.

The precipitate was rinsed, dried and ground and then again dried and thereafter, calcined at a temperature of 250° C. for 15 hours to obtain a photoconductive fine powder of $CdS(Cu).nCdCO_3$. The fine powder was removed from the quartz crucible and dispersed together with a heat curable acryl resin (manufactured by Dainihon Ink Co.) in a solvent of toluene and then uniformly sprayed on an aluminum support of cylindrical form into a thickness of 30 microns. Following this spraying, the coating was heat cured at a temperature of 200° C. for 1 hour to obtain the finished electrophotographic sensitive drum. In addition to the aforesaid sensitive drum, four other sensitive drums were prepared in the same manner with each containing 0.025, 0.05, 0.1 and 0.8 atomic % of copper per 100 atomic % of cadmium respectively.

Each of the photosensitive members was then charged by a corona discharge device to a surface potential of −800 volts and subsequently exposed to light to the measure spectral sensitivity characteristics the results of which are shown in FIG. 1. In this figure, the curves a, b, c, d and e respectively represent spectral sensitivity characteristics for photosensitive members containing 0.025, 0.05, 0.1, 0.4 and 0.8 atomic % and as is clear therefrom, the peak sensitivity tends to shift toward longer wave length side as the amount of copper increases. This means that a reddish colored original image will not be reproduced and in order to reproduce with high contrast, it is necessary to establish the peak of spectral sensitivity in the range close to the relative luminousity (which is 555 mμ). Thus, it can be seen that the curves a, b and c which are the photosensitive members with 0.025, 0.05 and 0.1 atomic % of copper per 100 atomic % of cadmium exhibit spectral sensitivities in which peaks thereof are close to the aforesaid relative luminousity.

Each of the five photosensitive members was charged and exposed to an original having a first image. After development, image transfer onto copying paper, cleaning and erasing by lamp exposure, the respective members were again charged and exposed to another original having a second image different from the first image. The electrostatic latent images which should correspond to the second image were developed and subsequently transferred. The final visual images respectively showed a residual image of the first image indicating that none of these members prevented the occurrence of the memory phenomenon.

Fifteen other photosensitive members, three of each for those five photosensitive members of CdS(Cu).n$CdCO_3$ containing 0.025, 0.05, 0.1, 0.4 and 0.8 atomic % of Cu per 100 atomic % of Cd, were prepared in the same manner as described above to examine the precision of manufacturing reproducibility. As a result, the photosensitive members containing 0.8 atomic % and 0.4 atomic % of copper showed stable characteristics on dark decay speed, charging capability and spectral sensitivity. However, the members with 0.1, 0.05 and 0.025 atomic % of copper showed instability in each of those characteristics indicating that copper must be added in large quantity to stabilize manufacturing reproducibility.

EXAMPLE 2

An aqueous solution containing 308.5 grams of cadmium nitrate and 0.68 grams of cupric chloride were admixed with an aqueous solution of ammonium carbonate to form a precipitate of $CdCO_3$(Cu) in accordance with reaction formula (4). In this, the presence of copper was 0.4 atomic % per 100 atomic % of cadmium. In the same manner, the precipitates of $CdCO_3$(Cu) containing 0.025, 0.05, 0.1 and 0.8 atomic % of copper per 100 atomic % of cadmium were prepared.

Each of the above 173 grams of $CdCO_3$(Cu) precipitate was dispersed in an aqueous solution of hydrogen sulfide to form a precipitate of CdS(Cu).n$CdCO_3$(Cu) in accordance with the reaction formula (6). Subsequently, these precipitates were rinsed, dried, ground and calcined at a temperature of 250° C. for 15 hours to obtain respective photoconductive fine powders with each containing uniformly diffused copper in CdS an $CdCO_3$. Respective powders were then dispersed in toluene with a heat curable acryl resin and the dispersions were sprayed to thicknesses of 30 microns on respective aluminum support drums and then heat cured at a temperature of 200° C. for 1 hour. Five of these photosensitive members each containing different amounts of copper thus prepared were charged to surface potentials of −800 volts, exposed to an original having red colored images, developed and then transferred to copy paper to examine the reproducibility against the red colored images. The results showed that the photosensitive members with 0.4 and 0.8 atomic % of copper were hardly able to reproduce red colored images whereas those with 0.025, 0.05 and 0.1 atomic % of copper reproduced red colored images in high density and high contrast. Accordingly, it is preferable that an amount of copper to be in the range of about 0.025 to 0.1 atomic % per 100 atomic % of cadmium in order to effectively reproduce red colored images.

In addition to the experiments conducted to examine the reproducibility of red colored original images, each of the photosensitive members were subjected to two successive image formations, first with an original having first image and second with another original having second image. The final images transferred to copying paper respectively showed the occurrence of a residual image of first image even though the photosensitive members were erased and cleaned after first image formation. Thus, these photosensitive members were found to be incapable of preventing the occurrence of the memory phenomenon and were not suitable for actual use.

Next, fifteen other photosensitive members, three of each of the above five photosensitive members of CdS(Cu).n$CdCO_3$(Cu) containing 0.025, 0.05, 0.1, 0.4 and 0.8 atomic % of Cu per 100 atomic % of Cd, were prepared in the same manner to examine the precision of manufacturing reproducibility. The results showed that all of the photosensitive members were uniform and stable in dark decay speed, charging capability and spectral sensitivity. Thus, it can be concluded that the process in accordance with reaction formulas (3) and (5) (or 4) and (6) was effective in attaining good manufacturing reproducibility regardless of an amount of copper added.

EXAMPLE 3

In the same manner as in Example 2, a photoconductive fine powder of CdS(Cu).n$CdCO_3$(Cu) containing 0.05 atomic % of copper per 100 atomic % of cadmium was prepared. This powder was dispersed in 90 grams of a heat curable acryl resin and 250 milliliter of toluene together with 3 parts by weight of manganese stearate per 100 parts by weight of said powder and sprayed onto an aluminum support to a thickness of 30 microns and subsequently heated at a temperature of 200° C. for 1 hour. This photosensitive member is represented by the symbol L in FIG. 2.

Other than this photosensitive member, eleven photosensitive members were prepared in the same manner as last described but each containing 3 parts by weight of either one of following material respectively instead of manganese stearate; magnesium stearate (represented by the symbol B in FIG. 2), zinc stearate (C), cadmium stearate (D), lead stearate (E), aluminum stearate (F), zirconium naphthenate (G), cobalt stearate (H), nickel stearate (I), iron stearate (J), copper stearate (K) and manganese naphthenate (M). These materials as well as manganese stearate are fatty acid metallic salts. The photosensitive member containing 0.05 atomic % of copper prepared in Example 2 was also used along with these photosensitive members for experiments described hereinbelow and represented by the symbol A in FIG. 2.

Thirteen of these photosensitive members thus prepared were subjected to memory phenomenon experiments conducted in the following manner. An original A having a uniform reflective density of 0.33 on its entire area (i.e., an original of grayish color over the entire area) is used as a first original and an original B having right half portion of reflective density of 2.36 (i.e., black over its area) and left half portion of reflective density of 0.01 (i.e., white over its area) is used as the second original. At first, the original A is used to make copy wherein an amount of exposure was set to permit reflective density of the actual copy to become 0.25. With an amount of exposure set constant, the original B was used to make ten copies successively by repeating the steps of charging the photosensitive member to a surface potential of −800 volts, exposure to the original, developing with a toner, transferring developed image onto copy paper, cleaning the residual toner image and erasing the residual charges. Following this, the original A is used to make copy of the same. If the memory phenomenon is to be present, then the copy obtained at least (i.e., the copy corresponding to original A after ten successive formations of copies from original B) should have residual images of the original B having right half of black color and left half of white color. For this purpose, reflective densities of right and left halves of the copy obtained at last were measured using reflective densitometer DM-273 manufactured by Dainippon Screen Co. The reflective density of left half is termed $D_1$ and right half termed $D_2$ and calculated to obtain reflective density difference $\Delta D$ by subtracting $D_1$ from $D_2$. As may be apparent, greater the difference $\Delta D$ is, the memory phenomenon is more pronounced. This experiment was repeated for 10 times for each of 13 photosensitive members the results of which are shown in FIG. 2.

Figure 2:
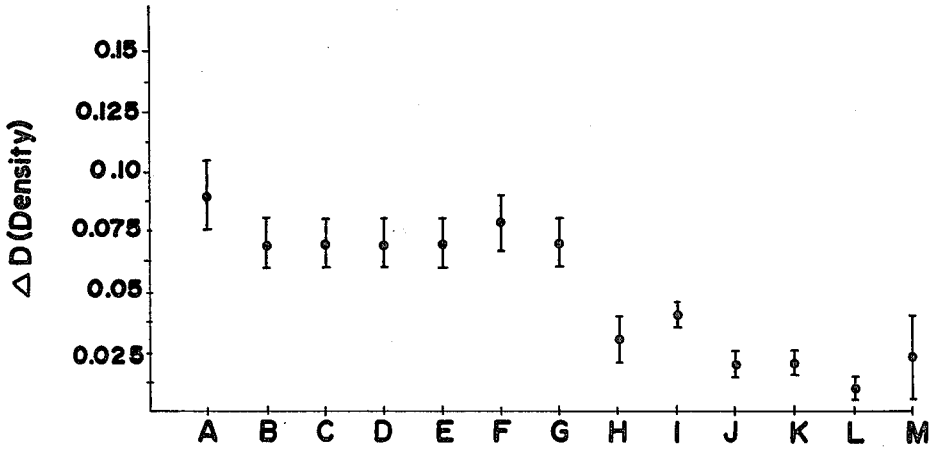
FIG. 2 is a graph illustrating experimental data showing the presence of the memory phenomenon with the use of electrophotographic sensitive members containing various additives.

In FIG. 2, the highest and lowest data of $\Delta D$ measured from the copy corresponding to original A after ten successive formations of copies from original B among the ten repeated experiments for each of those 13 photosensitive members are plotted. The black circles between the highest and lowest $\Delta D$ indicate the averages of $\Delta D$. As may be seen, $\Delta D$ was minimum for the photosensitive member L with manganese stearate indicating that manganese stearate is the most effective material for preventing memory phenomenon. While the photosensitive members J and K with iron stearate and copper stearate respectively showed some effectiveness in preventing memory phenomenon, they were determined to be impractical in use as they were found to be poor in reproducing red colored images. It was found that the photosensitive member with manganese, stearate did not in any way adversely affect the reproducibility of red colored images.

EXAMPLE 4

Figure 3:
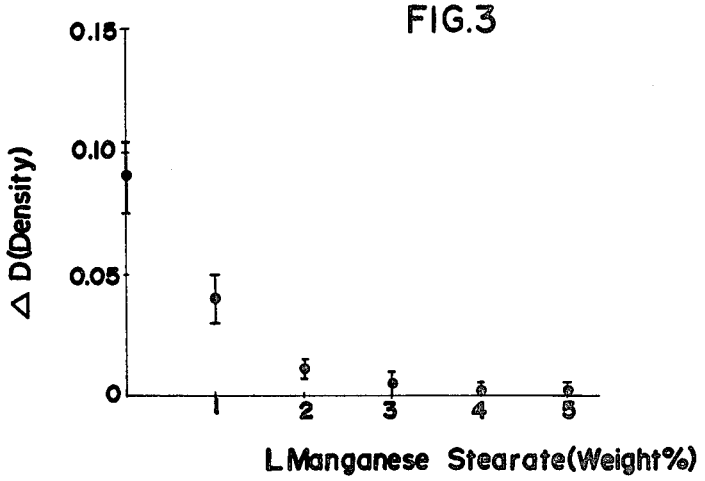
FIG. 3 is a graph showing experimental data of the memory phenomenon in accordance with the amount of manganese stearate added in the photoconductive insulating layer of an electrophotographic sensitive member according to the present invention.

Four photosensitive members similar to the photosensitive member containing 0.05 atomic % of copper and 3 parts by weight (3 weight %) of manganese stearate prepared in Example 3 were prepared in the same manner but each containing 1, 2, 4 and 5 parts by weight of manganese stearate per 100 parts by weight of photoconductive fine powder of $CdS(Cu).nCdCO_3(Cu)$. Four of these photosensitive members as well as the photosensitive members with no and 3 parts by weight of manganese stearate were subjected to memory phenomenon experiments in the same way as in Example 3. FIG. shows the results and it is seen that photosensitive members with 2 to 5 parts by weight of manganese stearate exhibited excellent effect in preventing memory phenomenon whereas those with no or 1 part by weight of manganese stearate did not prevent such phenomenon. The difference in $\Delta D$ observed in the photosensitive members with 3 parts by weight of manganese stearate in FIGS. 2 and 3 are believed to be caused by changes in the exposure conditions, development, etc. that may vary from one time to another.

Figure 4:
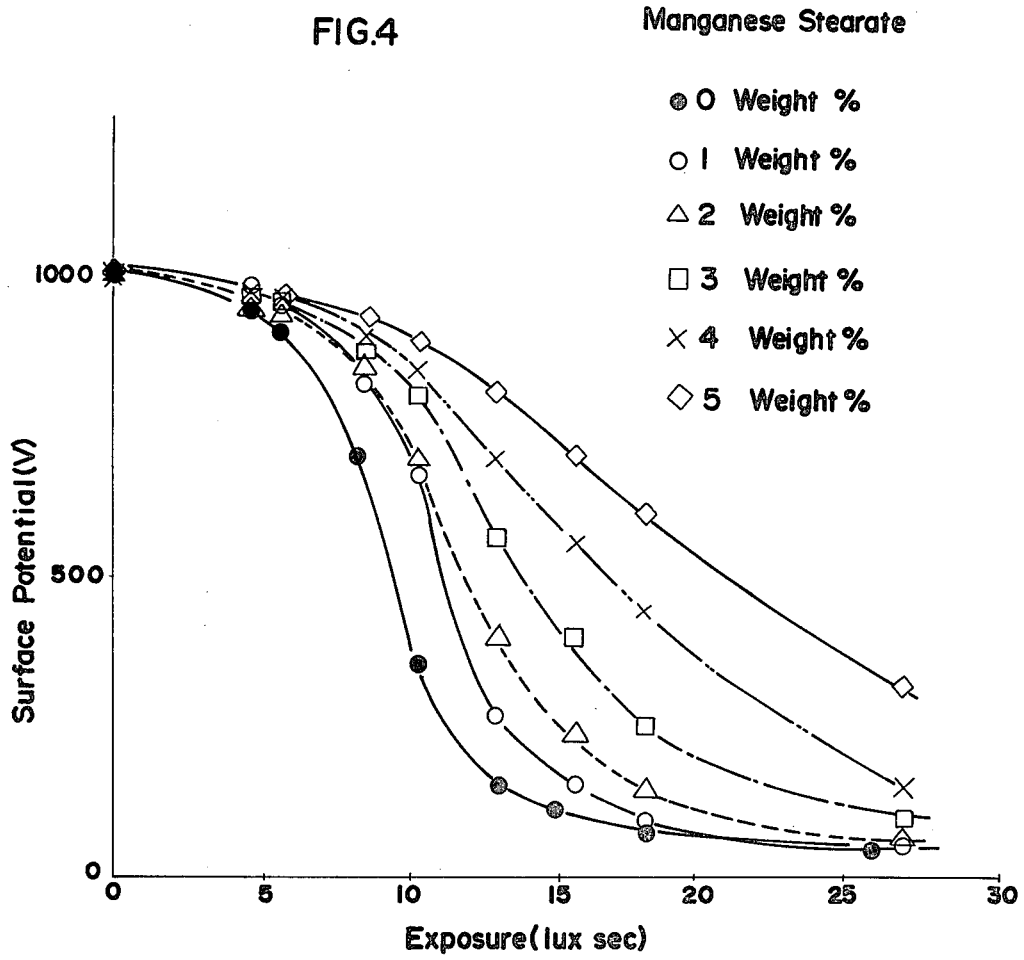
FIG. 4 is a graph showing the light decay characteristics for electrophotographic sensitive members with each containing a different amount of manganese stearate.

Next, each of these six photosensitive members were subjected to light decay characteristic experiments by charging the respective members to surface potentials of −1000 volts and subsequently exposing them to light. As may be seen from FIG. 4, the photosensitive member with no manganese stearate exhibits best light decay characteristic with the same becoming gradually poorer as the amount of manganese stearate increases. However, it was determined that the quality of image obtained was substantially the same and good for members with 1 to 4 parts by weight of manganese stearate whereas the member with 5 parts by weight did not reproduce a good image. From this, it can be concluded that the amount in the range of about 2 to 4 parts by weight of manganese stearate is best suited for preventing the memory phenomenon without degrading the quality of the image obtained.

EXAMPLE 5

To the photosensitive member L prepared in Example 3 which comprises the $CdS.nCdCO_3$ photoconductive layer containing 0.05 atomic % of copper and 3 parts by weight of manganese stearate, an insulating protective layer of thermo-setting acryl resin is formed in the following manner. A thermo-setting acryl resin under the tradename of Acryloid manufactured by Rohm and Haas is mixed with isopropyl alcohol at a weight ratio of 2 to 8 and then coated onto the photoconductive layer to have a thickness of about 1 to 2 microns when dried. Subsequently, this coating was heat cured at a temperature of 120° C. for 30 minutes.

This photosensitive member formed with the insulating protective layer is then put through actual running test by subjecting it to charging, image exposure, development with toner powder, image transfer onto paper, residual toner cleaning and residual charge erasing repetitively. As the cleaning means for cleaning residual toner, an elastic blade made of polyurethane and having an sharp edge contacting the surface of protective layer was used. After running through 10,000 copies, the photosensitive member was removed for examination of any physical damages on the surface of protective layer. As the result, no damages were observed. Also, adherence of toner was not observed hardly at all indicating that the provision of insulating protective layer was effective to prevent the cause for filming phenomenon.

While there have been described preferred embodiments of the present invention, it is apparent that numerous alterations, additions and omissions may be made without departing from the spirit thereof.

What is claimed is:

1. An electrophotographic sensitive member for use in an image transfer type copying apparatus which comprises a photoconductive insulating layer of a photoconductive powder of cadmium sulfide and cadmium carbonate with manganese stearate in an amount of about 2 to 4 parts by weight per 100 parts by weight of said photoconductive powder of $CdS.nCdCO_3$ and copper as an acceptor impurity included, said layer being formed by heat curing a dispersion of the powder, manganese stearate and a binding resin in a solvent.

2. An electrophotographic sensitive member for use in an image transfer type copying apparatus which comprises a photoconductive insulating layer formed by heat curing a dispersion applied on conductive support which dispersion includes a photoconductive fine powder of $CdS(Cu).nCdCO_3(Cu)$ $(0<n\leqq 4)$, manganese stearate, a thermo-setting resin and a solvent, said copper being present in an amount of about 0.025 to 0.1 atomic % per 100 atomic % of cadmium and said manganese stearate being present in an amount of about 2 to 4 parts by weight per 100 parts by weight of said powder.

3. An electrophotographic sensitive member as claimed in claim 2 wherein said photoconductive fine powder includes said copper uniformly diffused in said cadmium sulfide and cadmium carbonate and is obtained by the reactions in accordance with the following formulas:

$$Cd^{2+}+Cu^{2+}+CO_3^{2-}\rightarrow CdCO_3(Cu) \text{ and}$$

$$CdCO_3(Cu)+S^{2-}\rightarrow CdS(Cu).nCdCO_3(Cu).$$

4. An electrophotographic sensitive member as claimed in claim 2 wherein said resin includes an acryl resin and said dispersion is applied to conductive support in a thickness of about 10 to 100 microns.

5. An electrophotographic sensitive member as claimed in claim 2 further including an insulating protective layer having a thickness of about 0.2 to 2 microns and the material therefor includes at least one resin selected from the group consisting of silicon resin, acryl resin, melamine resin, fluorine resin, polyester resin, amino resin and urethane resin.

6. A method of producing an electrophotographic sensitive member for use in an image transfer type copying apparatus which comprises the steps of:

preparing photoconductive fine powder of $CdS.n\,CdCO3(0<n\leqq 4)$ with copper in an amount of about 0.025 to 0.01 atomic % per 100% of cadmium uniformly diffused in CdS and CdCO3;

adding 2 to 4 parts by weight of manganese stearate per 100 parts by weight of said fine powder either by directly adhering said manganese stearate to said fine powder or by dispersing it therewith in the next step;

dispersing said fine powder in a heat curable resin together with a solvent; and coating the resultant solution uniformly on an electroconductive support at a thickness of 10 to 100 microns and heat curing the same.

7. The method as claimed in claim 6 wherein said photoconductive fine powder is prepared by the steps which comprises:

reacting an aqueous solution of a soluble cadmium compound and an aqueous solution of a carbonate with copper in accordance with the formula of $$Cd^{2+}+Cu^{2+}+CO_3^{2-}\rightarrow CdCO_3(Cu);$$

reacting said precipitate of $CdCO_3(Cu)$ with sulfide in accordance with the formula of $$CdCO_3(Cu)+S^{2-}\rightarrow CdS(Cu).nCdCO_3(Cu); \text{ and}$$

calcining said precipitate of $CdS(Cu).nCdCO_3(Cu)$ at a temperature of less than 350°.

8. An electrophotographic sensitive member for use in an image transfer type copying apparatus comprising a binding resin having dispersed therein a photoconductive cadmium sulfide cadmium carbonate powder with copper as an acceptor impurity and manganese stearate in an amount of about 2 to 4 parts by weight per 100 parts by weight of said photoconductive powder.

9. The photographic sensitive member of claim 8 wherein said photoconductive powder contains between about 0.025 and 0.1 gram atomic weight of said copper to 100 gram atomic weight of cadmium.

* * * * *